United States Patent [19]

Sweet

[11] Patent Number: 4,512,329

[45] Date of Patent: Apr. 23, 1985

[54] HEAT CIRCULATING FIREPLACE GRATE ASSEMBLY FOR GAS FIRED LOGS

[76] Inventor: Steven W. Sweet, 10470 Metcalf, Overland Park, Kans. 66212

[21] Appl. No.: 600,007

[22] Filed: Apr. 13, 1984

[51] Int. Cl.[3] ..... F24B 7/00

[52] U.S. Cl. ..... 126/121; 126/131; 126/89; 126/116 R

[58] Field of Search ..... 126/135, 121, 129, 130, 126/131, 88, 89, 116 R, 90 R; 237/51

[56] References Cited

U.S. PATENT DOCUMENTS

| | | | |
|---|---|---|---|
| 4,008,703 | 2/1977 | Allgood | 126/121 |
| 4,178,908 | 12/1979 | Trexler, Sr. | 126/121 |
| 4,228,784 | 10/1980 | Malafouris | 126/129 X |
| 4,240,401 | 12/1980 | Chesnut et al. | 126/121 |
| 4,404,955 | 9/1983 | Sherman et al. | 126/131 X |

*Primary Examiner*—Larry Jones

*Attorney, Agent, or Firm*—Kokjer, Kircher, Bradley, Wharton, Bowman & Johnson

[57] ABSTRACT

An elongate manifold is supported in the fireplace chamber with the manifold spaced from the back of and above the fireplace floor. Gas logs are supported by a grate adjacent the manifold for heating same. A forced air blower is located behind the manifold between the manifold and the back wall of the fireplace. A vertical heat shield plate is interposed between the manifold and blower. A duct system connects the blower with the manifold and with the room served by the fireplace so as to draw air from the room, force it through the manifold and return it to the room. Thermostatic switch means limits the operation of the blower to times when the heat generated by the fireplace is substantial enough to be useful in forced air heating.

4 Claims, 4 Drawing Figures

HEAT CIRCULATING FIREPLACE GRATE ASSEMBLY FOR GAS FIRED LOGS

BACKGROUND AND SUMMARY OF THE INVENTION

This invention lies in the field of fireplace equipment and deals more particularly with apparatus for obtaining useable, forced air heat circulation from gas fired imitation logs.

For many years the use of gas logs for fireplaces enjoyed considerable popularity, principally because there were a large number of people who wanted the aesthetic effect of a fireplace fire but without the mess, bother, or costs involved in the burning of wood. Gas logs are more efficient than burning wood, and in most urban areas, the use of gas is cheaper. However, since the advent of what has been termed the "energy crisis", the burning of gas principally for aesthetic effects and not for heat energy has increasingly fallen out of favor. People do not want to pay for energy and see tremendous amounts of potentially useable heat being wasted up the fireplace chimney; and gas logs, for all their beauty and efficiency, still result in tremendous heat loss in this manner.

The adapting of forced air blowers into fireplaces in order to further utilize the heat generated by the fire has been known for some time, for example, as disclosed in U.S. Pat. No. 4,408,594. However, these units are primarily suited to wood burning applications. There has been considerable demand for units that would be adaptable to imitation gas log applications, and gas log manufacturers have been working on this problem for some time; however, no suitable unit has been forthcoming.

In all prior art units of which I am aware, the blowers, heat exchangers, and/or other components of the system are so located as to interfere with, or conceal, the desired ember and log effect of the gas logs and, in general, detract substantially from the desired aesthetic effect. Moreover, the units that are on the market do not effectively integrate with the log sets so as to enable them to physically fit in many smaller pre-fabricated fireplaces.

One of the principal objects of the present invention is to provide a compact combination gas log grate assembly and heat exchange system which (i) provides proper support for the logs and (ii) displays the logs and embers in a traditional way, and (iii) generates significant amounts of forced air heat into the room to which the fireplace is located. In my invention, the air circulating blower, the heat manifold, and the duct system are completely concealed from view and yet positioned in a heat protected environment which prevents damage to the motor. The gas logs and their burner are integrated with the system to maintain their aesthetic quality as well as to provide for efficient heat exchange, with the room air being circulated by the blower through the intense heat of the gas fire and returned back into the room.

Another important object of the invention is to provide a gas log grate assembly which integrates with the gas log but which can still be used with existing gas log sets. This is done by simply removing the grate of the old set and using the burner and logs with the present invention. This makes the unit suitable for the substantial retrofit market of those people who already own gas logs.

Another object of the invention is to provide a gas log fireplace heat exchange assembly that can be made and sold at a relatively low cost.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith, and in which like reference numerals indicate like parts in the various views.

Figure 1:
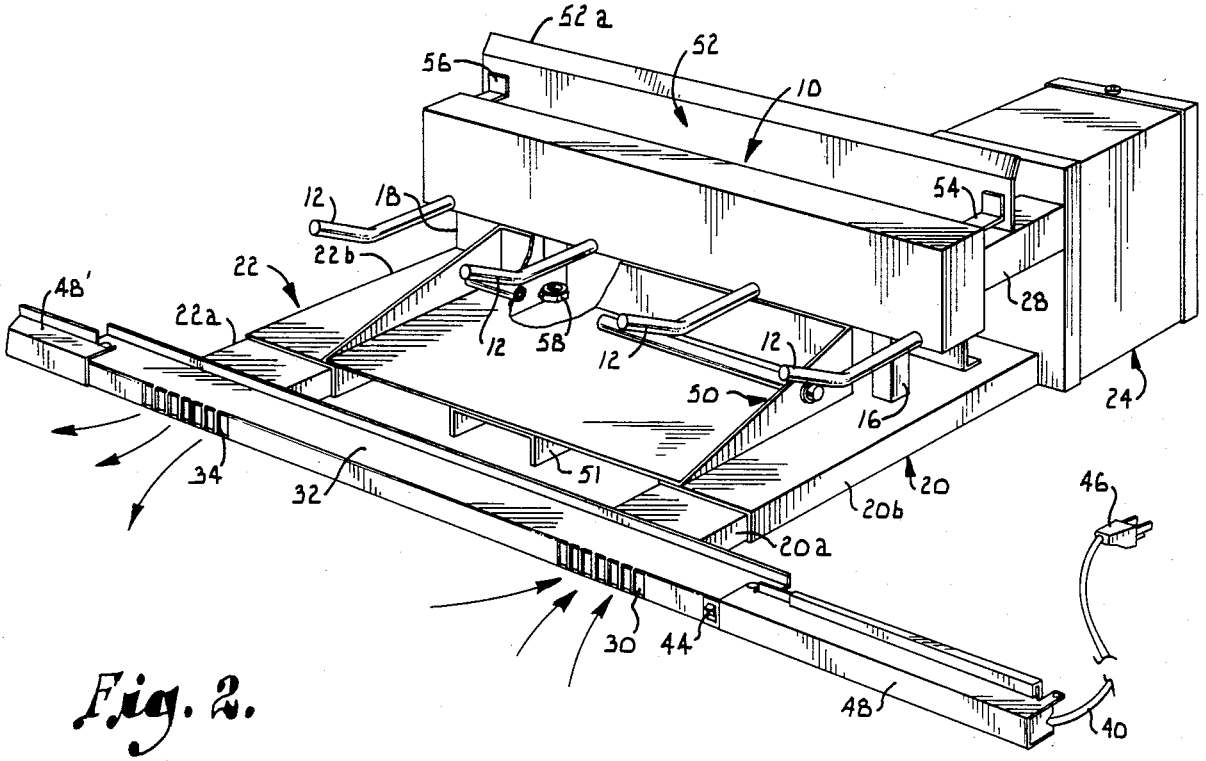
FIG. 1 is a front perspective view of fireplace grate assembly made in accordance with the invention.

Referring now to the drawings reference numeral 10 indicates a hollow rectangular box-like structure closed at both ends. Box 10, which is preferably made of tubular steel, comprises the basic heat exchanger manifold for the grate assembly. Secured to the front face of the manifold are forwardly extending spaced parallel grate bars 12 which provide support for the gas logs 14 (see FIG. 4). The manifold 10 is supported from below by an upright post 16 located near one end and by an upright hollow duct section 18 at the other. Post 16 is secured to the top of the horizontal intake duct section 20. The upright duct 18 is mounted on and communicates with the interior of the discharge duct section 22.

The air circulating blower for the unit is located within a hollow casing 24 which is disposed behind the manifold 10. The blower 26 is a squirrel cage blower having the motor housing **26*a* and the blower housing 26*b*, th latter being provided with the intake opening 26*c*. The discharge outlet 26*d* of the blower is connected with one end of a hollow duct section 28 which in turn connects the other end with the interior of manifold 10 so that the air is delivered from the blower into and through the manifold 10**.

Intake air from the room flows into the intake duct 20 through a drill 30 which is formed in the front face of a rail section 32 which is U-shaped in cross-section. A similar grill 34 is positioned to pass air into the room from the discharge duct 22.

The intake and discharge ducts 20 and 22 are each formed of telescopically connected sections and preferably are of steel also. The outermost sections **20*a*, 22*a* fit within the innermost sections 20*b*, 22*b*. The innermost section 20*b* of the intake duct 20 is connected with and communicates with the interior of the casing 24 for the blower as shown in FIG. 4. The outermost sections 20*a*, 22*a* can be adjusted fore and aft so as to accommodate fireplaces of differing depth or where adjustment is necessary to accommodate existing gas piping or other impediments. The amount of separation of the duct sections is limited by a stop arm 36 (FIG. 3) attached at one end to the inside of the rail 32 and extending parallel with intake duct 20. Arm 30 extends slidably through an aperture in a slide bracket 38 affixed to the side of duct section 20*b*. Arm 36 has the right angle tip 36*a* which, when the ducts are being extended, will be engaged by bracket 38** to limit further movement thus to keep the duct sections from separating from one another.

Electrical energy is supplied to the blower motor by means of an electric cord 40. The electrical circuit is controlled in two ways, one by a thermostat switch 42 located adjacent the motor housing and the other by a two speed selector switch 44 which in the preferred embodiment is located in the front of the rail 32 adjacent the intake duct. The electric cord extends from switch 44 through the intake duct 20 to the motor. The thermostat switch 42 is connected in series with the speed selector switch 44. The thermostat switch 44 is mounted on the side of the blower casing 24. A metallic heat transfer bar 43 contacts the switch, extending rearwardly from and connected with a heat shield later to be described. The thermostat switch is designed to turn the blower on when the temperature reaches a predetermined value, e.g., 110° F. and to turn it off when it drops below a selected minimum temperature, e.g., 90° F. The electric cord is energized through the usual wall socket (not shown) by means of a pronged jack 46. That part of the cord located between the switch 44 and the jack may be concealed in an extension 48 connected with and extending from the end of rail 32. A similar extension 48', if needed for fill in or decorative purposes, may be connected with the opposite end of rail 32.

Positioned on and extending between the ducts 20, 22 beneath the grate arms 12 is the combined ember pan and gas burner pipe 50 which forms a part of conventional gas log sets. If necessary an additional support member 51 can be placed on the fireplace floor beneath the central portion of the pan to assist in supporting it in a level position.

Located behind the manifold 10 and the ember pan and acting as a shield and heat deflector for the blower housing 24 and the region adjacent to it is the vertically disposed heat shield 52. Preferably this extends the full length of and is spaced to the rear of the manifold. As can best be seen in FIG. 4, the heat shield rests upon and is secured at its lower edge to the tops of ducts 20 and 22. The heat shield is preferably also made of steel. It has the bent back of angled upper section **52*a* and is cut to fit around the duct section 28. It is secured to and spaced from the manifold 10 by the horizontally extending brackets 54, 56** near the opposite ends. The heat shield not only serves to protect the motor from the gas flame but also supports the top logs of the log set. It thus replaces the rear bottom log of a typical gas log set.

Figure 2:
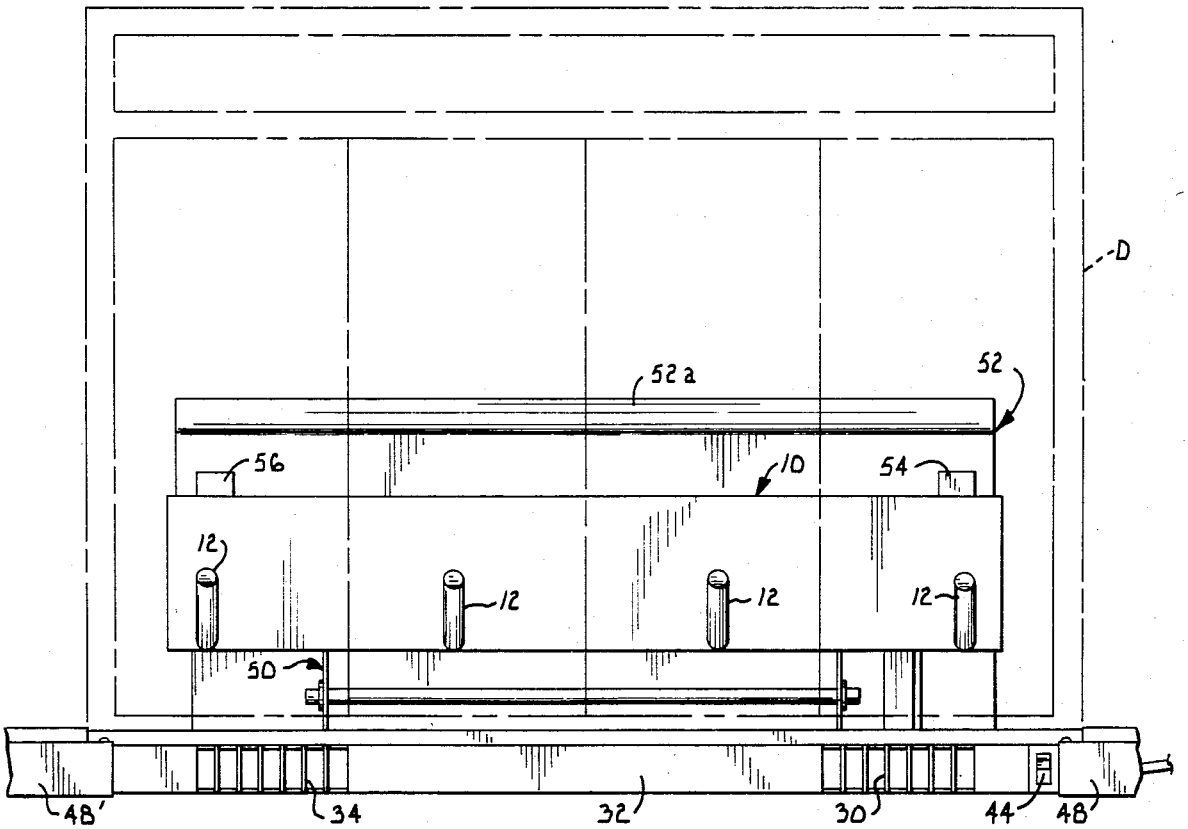
FIG. 2 is a front elevational view of same, the broken lines indicating representations of the outline of a fireplace and fireplace doors.
Figure 3:
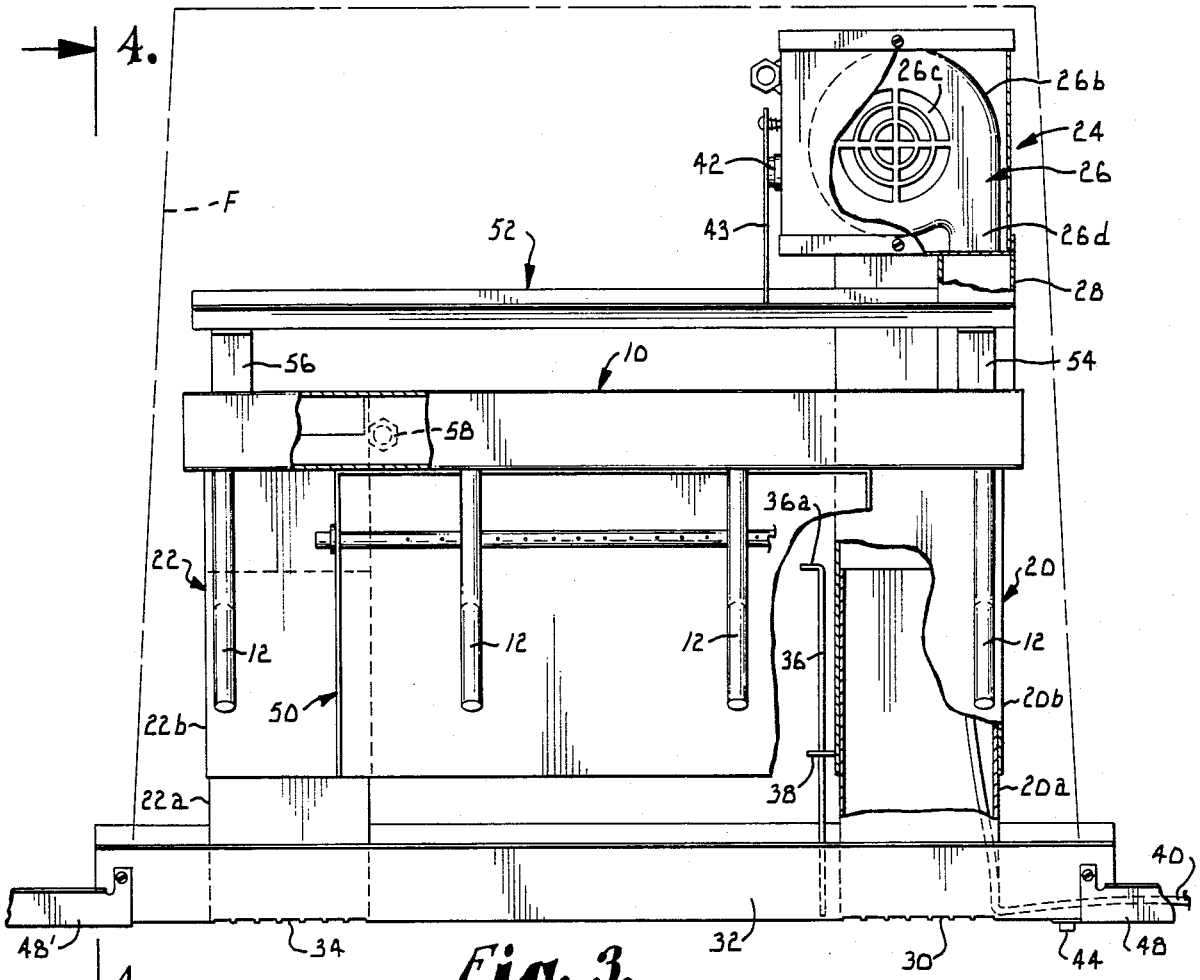
FIG. 3 is a top plan view of same, parts being broken away for purposes of illustration.
Figure 4:
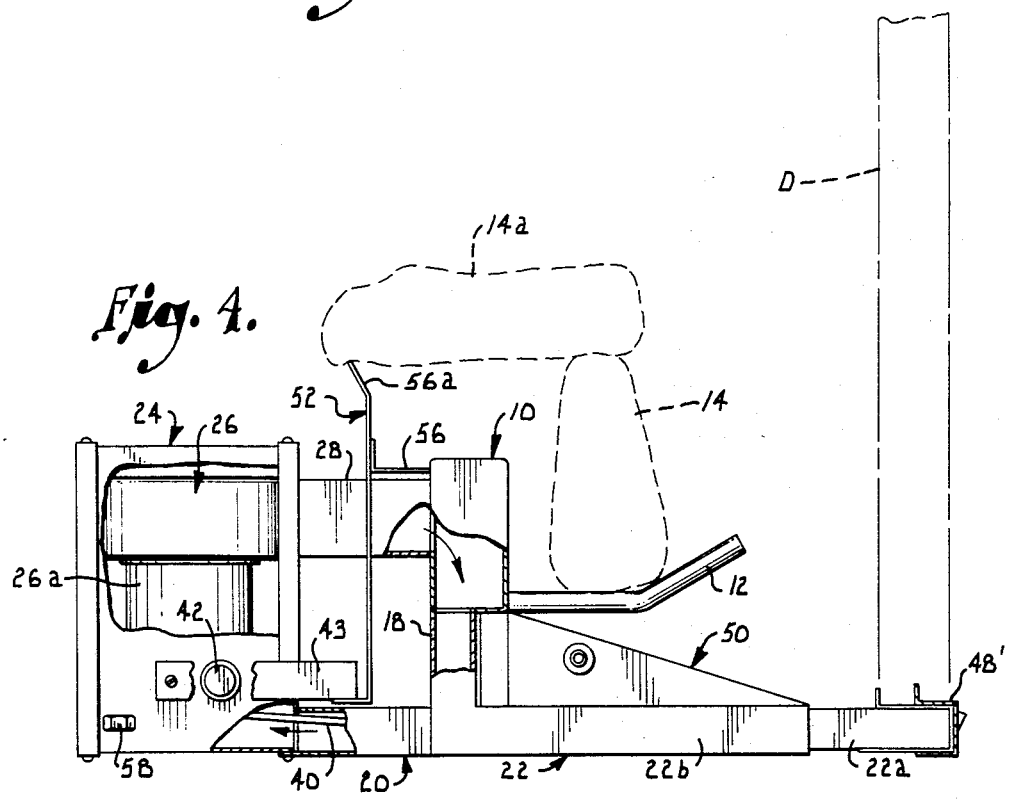
FIG. 4 is a side elevational view of same being taken generally along line 4—4 of FIG. 3.

FIGS. 2, 3 and 4 illustrate generally the positioning of the grate assembly in a typical fireplace. The side and back walls of the fireplace are represented by the broken line F in FIG. 3. The screen or glass doors for the front are represented by broken lines D in FIGS. 2 and 4.

As the level of base or floor of the fireplace may vary with respect to the hearth the assembly includes level adjustment nuts 58 which are welded to the channels and provide a mounting for adjustment bolts (not shown) which can be adjusted as desired as to provide additional support for the assembly. Alternately, the unit can be equipped with feet at the appropriate locations for maintaining the unit level.

The operation of the grate assembly of the invention is believed to be substantially evident from the preceding description. The unit is placed in the fireplace with the ducts 20, 22 so adjusted that the grills 30 and 34 are located below the glass doors or outside the plane of the screen so that there will be no interference with the air flow into or out of the respective grills. The front bottom log 14 is placed in position on the grate arms 12 and the top logs **14*a* are supported by it and also by the upper portion 52*a* of the heat shiled. They thus effectively screen from view the manifold 10** and the heat shield when in position. The motor housing and its associated ducts are also screened from view by the logs and are protected from direct radiation from the logs and manifold by the heat shield.

The burner pan, which is part of the conventional gas log set and not part of this invention, is hooked with the gas supply (not shown). Sand, embers, and large granules are used to cover any visible portion of the burner pan and the intake and exhaust ducts 20, 22.

The thermostatic switch will control the on off condition of the blower as previously described. Speed selection can be made through manipulation of the speed switch 44.

In addition the unit may be made in mirror image to reverse the air flow and provide more open space in the back right portion of the fireplace for gas piping.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A gas log grate assembly for a fireplace, said grate assembly including, (a) an elongate generally horizontal air manifold having an inlet near one end and an outlet near the other;

(b) means for supporting said manifold between the front and back of the fireplace and spaced above the floor of the fireplace;

(c) an air circulating blower positioned between said manifold and the back of the fireplace;

(d) duct means connected with the inlet to and outlet from said manifold and with said blower and providing for intake of air from outside the fireplace into and through the blower and to said manifold and back from the manifold to outside the fireplace;

(e) means for supporting gas fired logs in close proximity to said manifold; and (f) heat shield means disposed between said manifold and said blower.

2. A gas log grate assembly as in claim 1, (a) said heat shield means comprising a substantially upright plate located between said manifold and said blower.

3. A gas log grate assembly as in claim 1, (a) said means for supporting gas logs including a plurality of grate arms extending laterally forwardly from said manifold, said arms spaced from one another along the manifold.

4. A gas log grate assembly as in claim 1, (a) said duct means including, (i) an intake duct spaced below said manifold and extending from the front of the fireplace beneath the inlet end of said manifold and past said heat shield means to said blower, (ii) intermediate duct means connecting the discharge from the blower to the inlet to said manifold, (iii) a discharge duct parallel with said intake duct and spaced below the outlet end of said manifold and extending to the front of the fireplace, and (iv) intermediate duct means connecting said outlet from the manifold with the discharge duct whereby to provide a flow path for air from the manifold to the front of the fireplace.

* * * * *